US008116898B2

(12) United States Patent
Chung et al.

(10) Patent No.: US 8,116,898 B2
(45) Date of Patent: Feb. 14, 2012

(54) DIGITAL GARMENT USING KNITTING TECHNOLOGY AND FABRICATING METHOD THEREOF

(75) Inventors: Gi Soo Chung, Gyeonggi-do (KR); Dae Hoon Lee, Gyeonggi-do (KR); Jae Sang An, Gyeonggi-do (KR)

(73) Assignee: Korea Institute of Industrial Technology, Chungcheongnam-do (KR)

( * ) Notice: Subject to any disclaimer, the term of this patent is extended or adjusted under 35 U.S.C. 154(b) by 0 days.

(21) Appl. No.: 12/919,294

(22) PCT Filed: Jun. 27, 2008

(86) PCT No.: PCT/KR2008/003725

§ 371 (c)(1),
(2), (4) Date: Aug. 25, 2010

(87) PCT Pub. No.: WO2009/107906

PCT Pub. Date: Sep. 3, 2009

(65) Prior Publication Data

US 2011/0010001 A1 Jan. 13, 2011

(30) Foreign Application Priority Data

Feb. 26, 2008 (KR) ..... 10-2008-0017485

(51) Int. Cl.
*G06F 19/00* (2011.01)

(52) U.S. Cl. ..... 700/141; 2/905

(58) Field of Classification Search ..... 700/141; 66/171, 202; 2/902

See application file for complete search history.

(56) References Cited

U.S. PATENT DOCUMENTS

| | | | | |
|---|---|---|---|---|
| 4,753,088 | A * | 6/1988 | Harrison et al. | 66/202 |
| 6,145,551 | A | 11/2000 | Jayaraman et al. | |
| 6,341,504 | B1 * | 1/2002 | Istook | 66/202 |
| 6,381,482 | B1 | 4/2002 | Jayaraman et al. | |
| 6,501,055 | B2 | 12/2002 | Rock et al. | |
| 6,941,775 | B2 | 9/2005 | Sharma | |
| 7,779,656 | B2 * | 8/2010 | Dias et al. | 66/202 |
| 7,878,030 | B2 * | 2/2011 | Burr | 66/173 |
| 2007/0298666 | A1 | 12/2007 | Kurth | |

OTHER PUBLICATIONS

International Search Report mailed Jan. 13, 2009 for PCT/KR2008/003725.

Written Opinion of the International Search Report mailed Jan. 13, 2009 for PCT/KR2008/003725.

* cited by examiner

*Primary Examiner* — Nathan Durham

(74) *Attorney, Agent, or Firm* — Yoo & Associates, Inc.

(57) ABSTRACT

A digital garment and a fabrication method thereof are provided. The digital garment is fabricated using a knitting technique. The digital garment comprises a plurality of knitting yarns forming loops at regular intervals and interwoven through the loops, and one or more conductive digital yarns tied to the loops of the knitting yarns to form high-speed information communication circuits. The knitting yarns and the digital yarns are knitted together into a garment. During knitting, the digital yarns are used to form high-speed information communication circuits in a rapid and economical manner.

15 Claims, 12 Drawing Sheets

DIGITAL GARMENT USING KNITTING TECHNOLOGY AND FABRICATING METHOD THEREOF

This application claims the priority of Korean Patent Application No. 10-2008-0017485, filed on Feb. 26, 2008 in the KIPO (Korean Intellectual Property Office), the disclosure of which is incorporated herein entirely by reference. Further, this application is the National Stage application of International Application No. PCT/KR2008/003725, filed Jun. 27, 2008, which designates the United States and was published in English. Each of these applications is hereby incorporated by reference in their entirety into the present application.

TECHNICAL FIELD

The present invention relates to a digital garment using a knitting technique and a method for fabricating the same.

BACKGROUND ART

In the near future, people will be living in a ubiquitous world where they can access networks in real time to exchange information everywhere at any time. Under these circumstances, digital garments are required for ease of access to surrounding networks. Thus, there is a need for digital yarn, which is a kind of thread through which electrons can migrate to deliver information, suitable for the fabrication of digital garments.

When it is intended to use digital yarns to manufacture digital fabrics capable of communicating with electronic modules, communication circuits or lines are not linearly connected to electronic modules but their positions are varied (e.g., upward, downward, left and right directions) depending on the arrangement of the electronic modules.

Warp threads and weft threads constituting a fabric are woven only in selected directions (e.g., upward/downward or left/right directions). For example, after warp threads and weft threads are woven in right and left directions, they cannot be woven in upward and downward directions. That is, it is impossible to weave warp threads and weft threads in various directions.

In the meanwhile, digital yarns can be woven in various desired directions using a knitting technique to create communication circuits or lines capable of connecting electronic modules. Until now, however, no research and development has been conducted on the fabrication of digital garments using a knitting technique.

DISCLOSURE

Technical Problem

The present invention has been made in an effort to solve the problems of the prior art, and it is an object of the present invention to provide a digital garment that is fabricated using a knitting technique, knitting yarns and digital yarns, thereby eliminating the need for additional processing to weave or connect the digital yarns and reprocessing the digital yarns.

It is another object of the present invention to provide a method for fabricating the digital garment.

Technical Solution

In accordance with an aspect of the present invention, the above and other objects can be accomplished by the provision of a digital garment comprising a plurality of knitting yarns forming loops at regular intervals and interwoven through the loops, and one or more digital yarns woven with the knitting yarns and through which a current flows, wherein the knitting yarns and the digital yarns are knitted together into a garment.

The digital yarns may be woven in the horizontal or vertical direction with respect to the loops of the knitting yarns.

The digital yarns may form loops at regular intervals and the loops of the digital yarns may be tied to the loops of the knitting yarns.

The digital yarns may form loops at regular intervals and the loops of the digital yarns may be tied to loops of other digital yarns.

The digital yarns may be knitted in a wave-like pattern with the knitting yarns or another digital yarn.

The knitting yarns and the digital yarns may be knitted into a mesh stitch, a cable stitch, a rib stitch, a plain stitch or a combination thereof.

The digital garment may comprise a body portion and arm portions disposed opposite to each other at both sides of the body portion wherein the body portion and the arm portions are integrally knitted without any seams and the digital yarns are woven with the knitting yarns from one of the arm portions to the other arm portion via the body portion.

In the digital garment, the digital yarns may be knitted with the knitting yarns in the horizontal or vertical direction with respect to the body portion.

A device selected from soft touch pads, electric screens, sensors, wireless communication modules, computing devices and electric modules may be electrically connected to each end of the digital yarns.

The knitting yarns may be single-ply yarns or multiple-ply yarns.

Each of the digital yarns may include at least one metal line positioned at the center of the cross section thereof to provide a communication path, and a coating layer surrounding the metal line to shield electromagnetic waves.

The metal line may be made of a material selected from copper, copper alloys, silver, silver alloys, gold, gold alloys, brass and combinations thereof.

The metal line may include a first metal line positioned at the center of the cross section thereof and a second metal line surrounding the outer circumference of the first metal line.

The first and second metal lines may be made of different materials.

The metal line may further include a third metal line surrounding the outer circumference of the second metal line.

The third metal line may be made of a material different from that of the second metal line.

Each of the digital yarns further includes outer metal lines arranged along the outer circumference of the coating layer and an outer coating layer surrounding the outer metal lines.

The outer metal lines may be arranged at regular intervals.

The outer metal lines may be arranged densely along the outer circumference of the coating layer.

In accordance with another aspect of the present invention, there is provided a method for fabricating a digital garment, the method comprising: selecting a particular garment design from a plurality of predetermined garment designs; selecting a particular circuit design from a plurality of predetermined circuit designs; knitting a plurality of knitting yarns so as to conform to the selected garment design and knitting one or more digital yarns to form circuits corresponding to the selected circuit design between the knitting yarns; stitching the knitted fabric to fabricate a garment; and electrically connecting electronic devices to the circuits of the digital yarns in the garment.

In the garment design selection step, a coat garment design may be selected in which a body portion and arm portions are disposed opposite to each other at both sides of the body portion; in the knitting step, the knitting yarns and the digital yarns may be knitted without any seams between the body portion and the arm portions, and the digital yarns may be integrally knitted from one of the arm portions to the other arm.

The garment design selection step, the circuit design selection step and the knitting step may be carried out using a knitting machine, the knitting machine comprising an input unit for selecting a garment design, a circuit design and a knitting program, a control unit for loading the garment design, the circuit design and the knitting program from a memory in response to input signals of the input unit to process the loaded data, an actuator mechanically operating in response to control signals of the control unit, and a cam operated by the actuator.

In the knitting step, the circuits may be formed by knitting the digital yarns in the horizontal or vertical direction with respect to the garment.

ADVANTAGEOUS EFFECTS

According to the digital garment and the fabrication method of the present invention, the knitting of knitting yarns with digital yarns enables the fabrication of the digital garment in a simple and rapid manner at low cost.

In addition, the use of a knitting technique enables the fabrication of the digital garment in a simple manner without any stitched portions (i.e. seams) in portions of the garment through which digital yarns pass.

Furthermore, communication circuits or lines are naturally formed using digital yarns during knitting of knitting yarns, thus eliminating the need for additional processing to form the digital yarns, which makes it possible to simply fabricate the digital garment.

| Brief explanation of essential parts of the drawings | |
|---|---|
| 100: Digital garment using knitting technique | |
| 110: Knitting yarns | 110r: Loops |
| 120: Digital yarns | 120r: Loops |
| 121: Metal lines | 122: Coating layer |
| 123: Voids | 124: Cover yarns |
| 130: Body portion | 140: Arm portions |
| 151: Soft touch panel | 152: Electric screen |
| 153: Sensor | 154: Wireless communication module |
| 155: Computing device | 156: Electric module |
| 300: Knitting machine | 310: Input unit |
| 320: Memory | 330: Control unit |
| 340: Actuator | 350: Cam |
| 360: Monitor | |

MODE FOR INVENTION

Preferred embodiments of the present invention will now be described in detail with reference to the accompanying drawings, such that those skilled in the art can easily practice the present invention.

Figure 1:
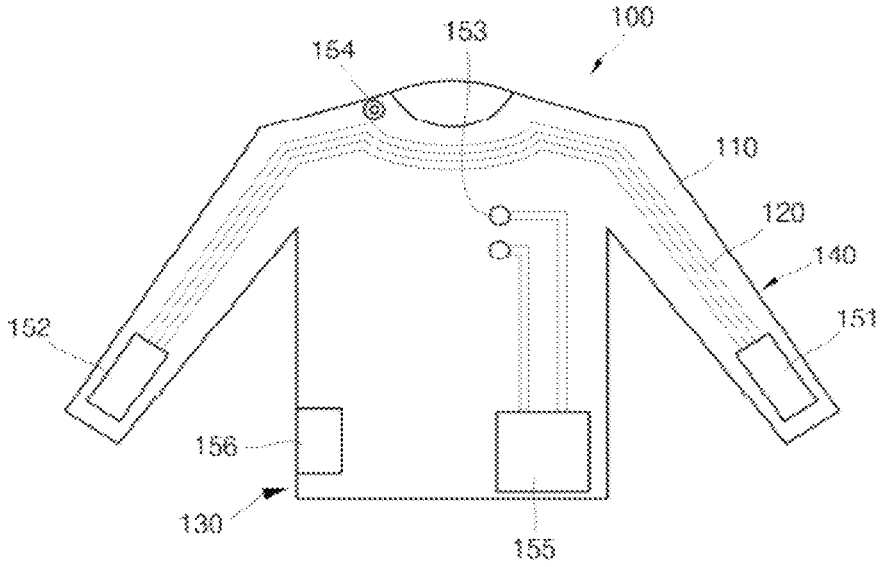
FIG. 1 is a plan view illustrating a digital garment according to an embodiment of the present invention.
Figure 2:
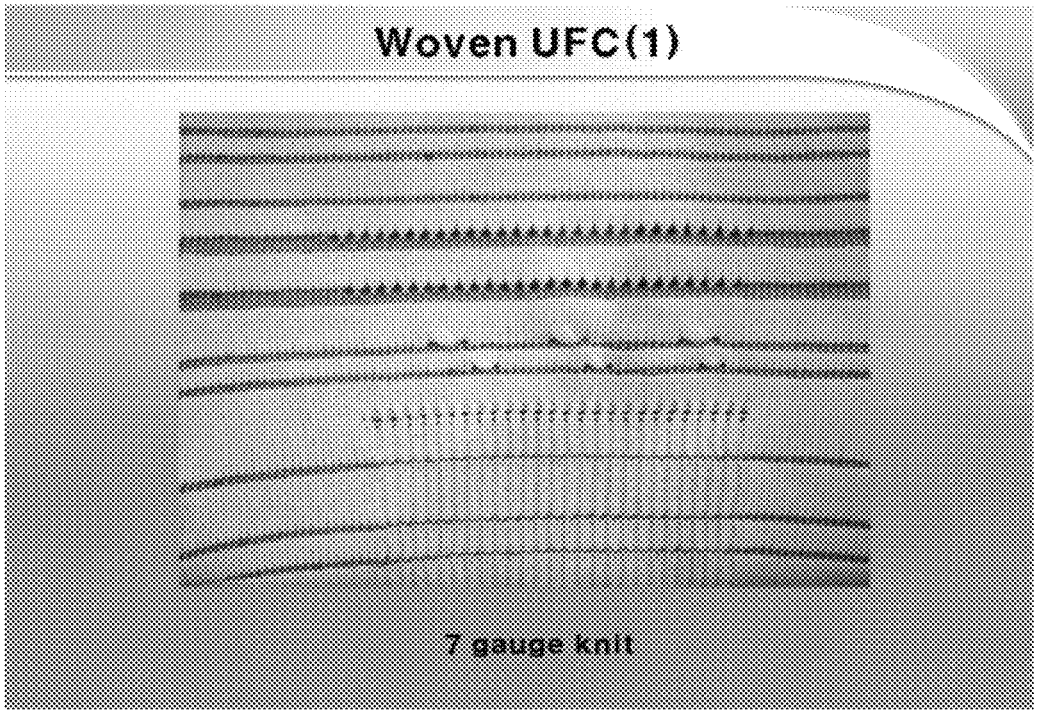
FIG. 2 through FIG. 10 show photographs of some areas of a digital garment according to the present invention.
Figure 3:
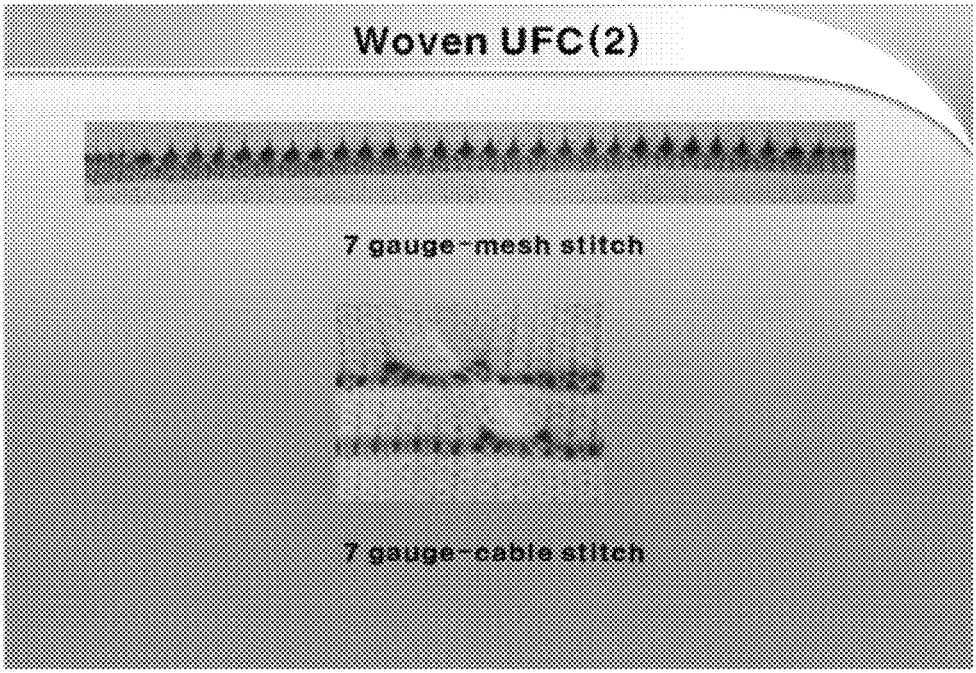
Figure 4:
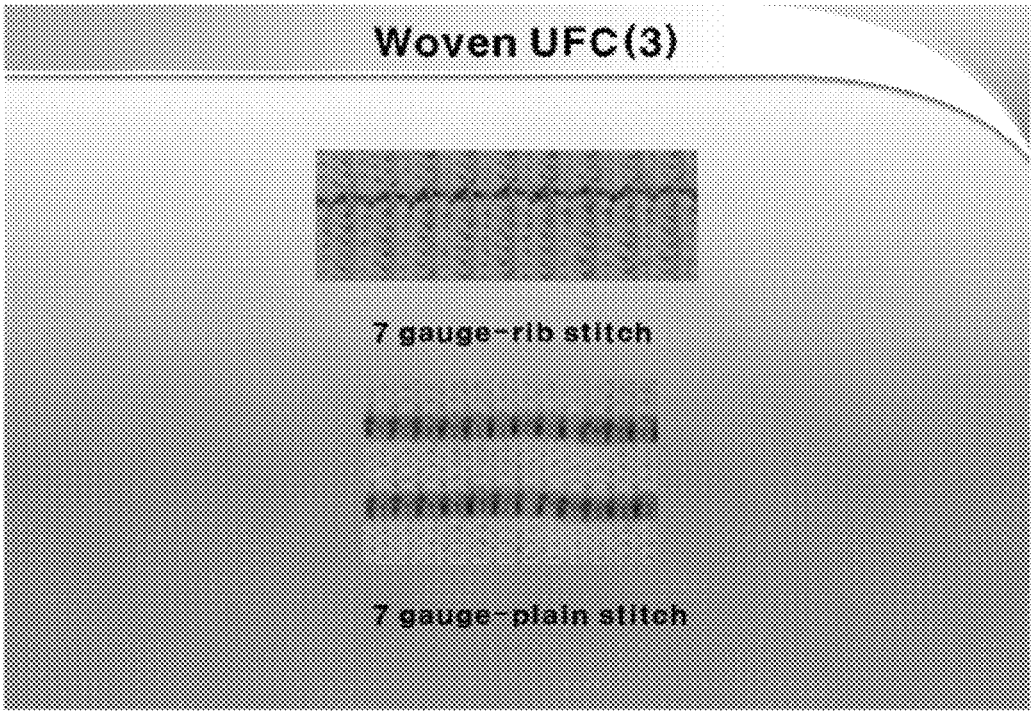
Figure 5:
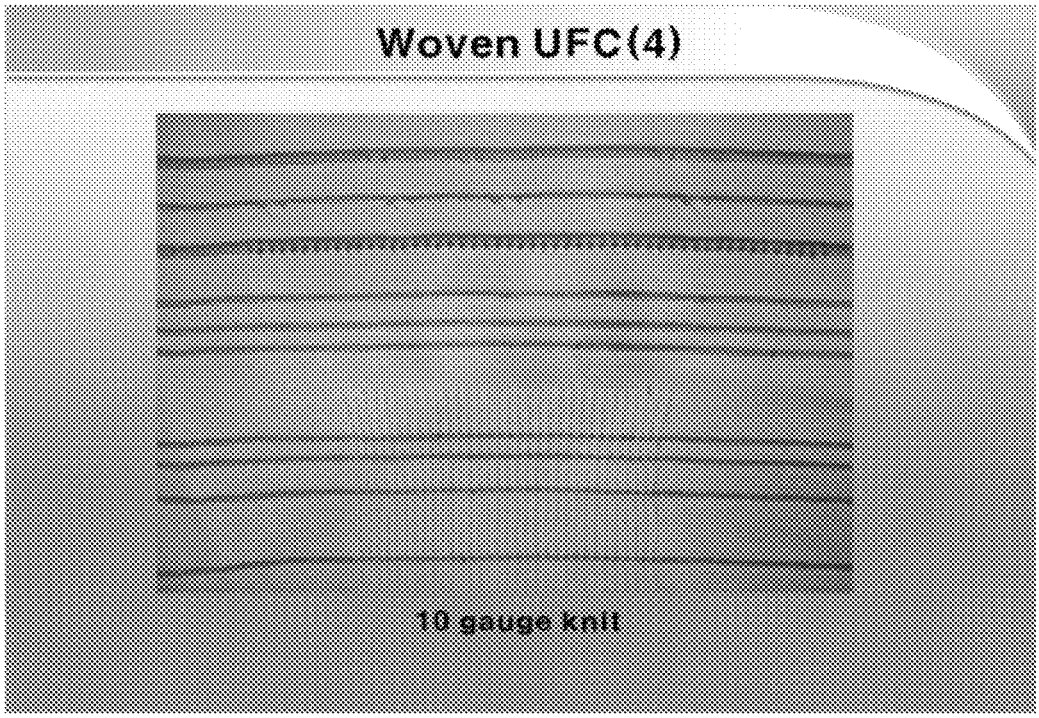
Figure 6:
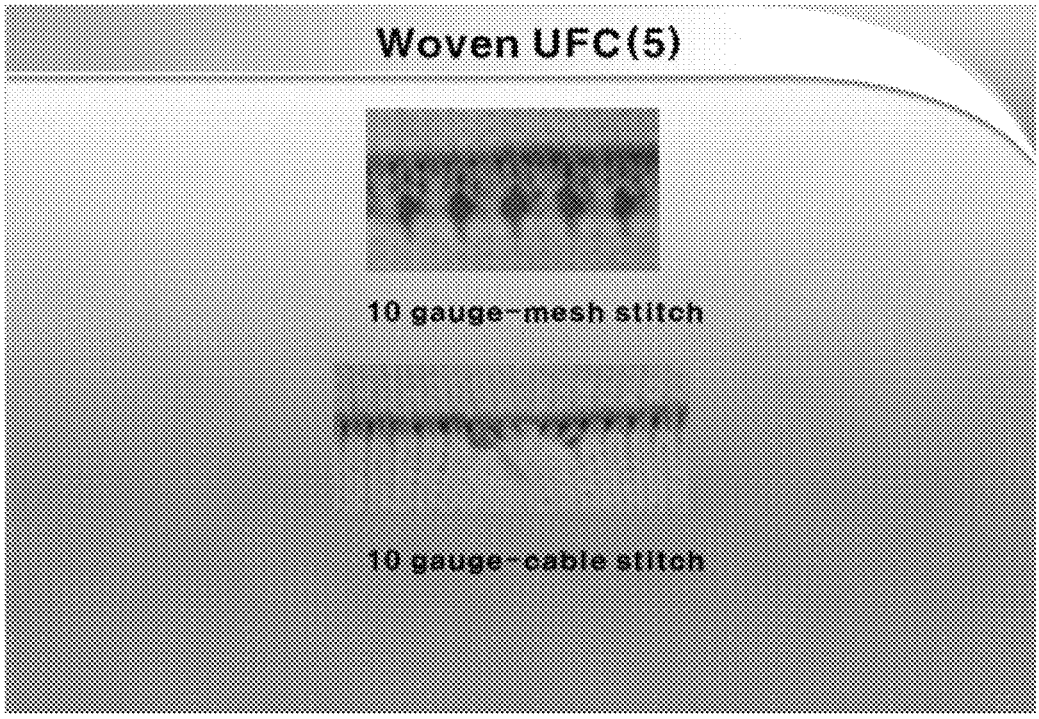
Figure 7:
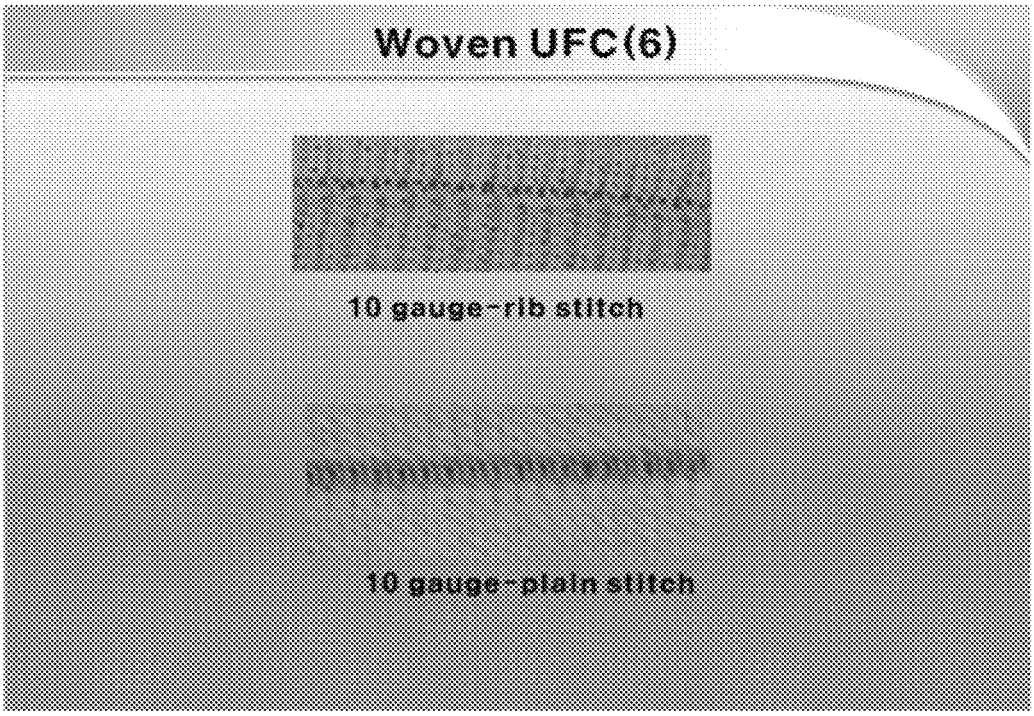
Figure 8:
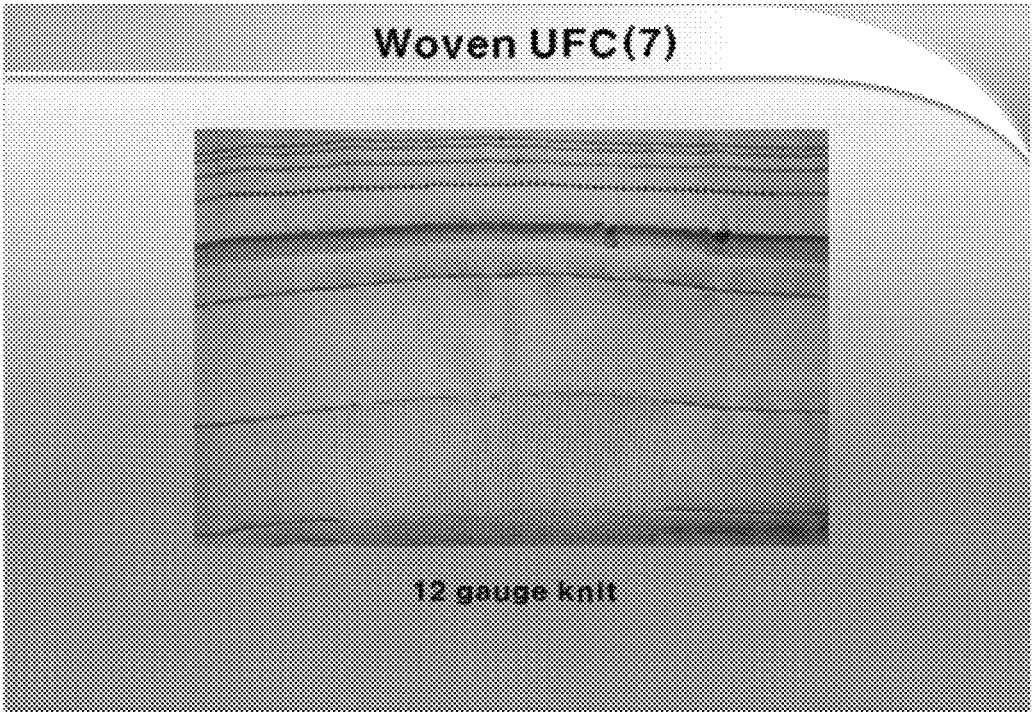
Figure 9:
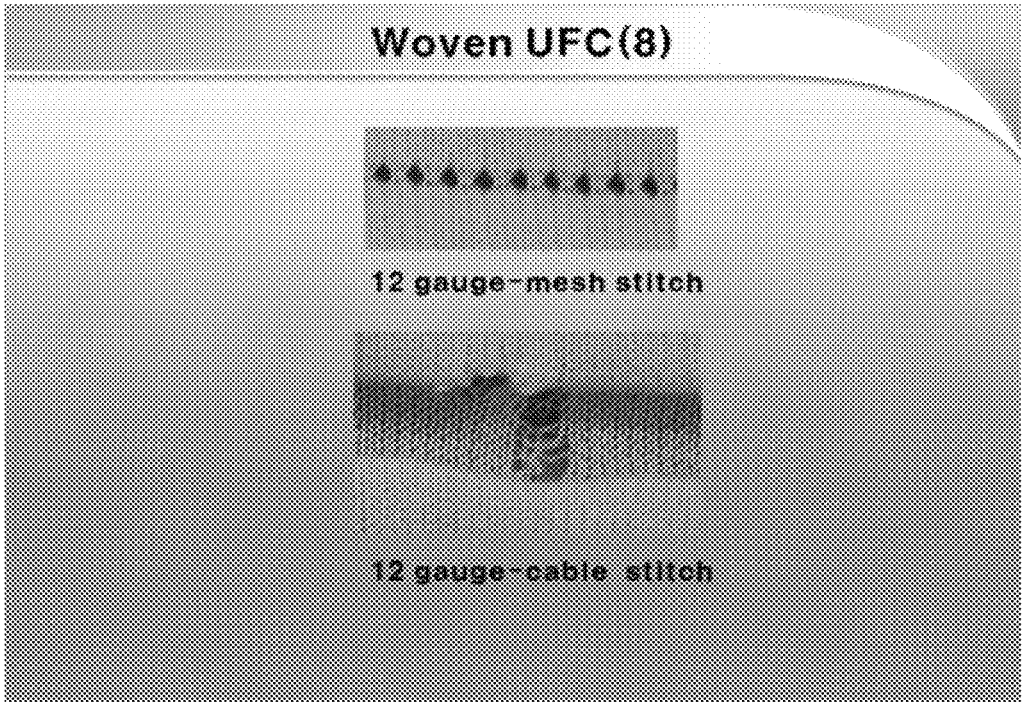

FIG. 1 is a plan view illustrating a digital garment 100 according to an embodiment of the present invention.

As illustrated in FIG. 1, the digital garment 100 comprises a plurality of knitting yarns 110 interwoven through loops (not shown), and one or more digital yarns 120 woven with the knitting yarns 110 and through which a current flows. There is no restriction on the form of the digital garment 110. For example, the knitting yarns 110 and the digital yarns 120 can be knitted into a coat as the digital garment 110. That is, the digital garment 110 may comprise a body portion 130 and arm portions 140 disposed opposite to each other at both sides of the body portion 130. Examples of other applications of the digital garment 110 include clothes, such as sweaters, cardigans, shirts and waistcoats, and clothing accessories, such as shawls, hats and gloves.

No stitched portions (i.e. seams) between the body portion 130 and the arm portions 140 of the digital garment 100 in the form of a coat are formed, so that communication circuits or lines using the digital yarns 120 can be formed from one of the arm portions 140 to the other arm portion 140 via the body portion 130. However, it should be understood that the digital yarns 120 are knitted with the knitting yarns 110 in a vertical direction as well as a horizontal direction with respect to the body portion 130 to form communication circuits or lines.

Further, a device selected from a soft touch pad 151, an electric screen 152, a sensor 153, a wireless communication module 154, a computing device 155, an electric module 156 and equivalents thereof can be electrically connected to each end of the digital yarns 120. No limitation is imposed on the kind of devices electrically connected to the digital yarns 120. Further, the digital yarns 120 can be electrically connected to the devices 151 through 156 through suitable connectors, such as LAN cables and LAN cards, or by direct soldering.

The connected portions between the digital yarns 120 and the devices 151 through 156 are waterproofed to prevent water from permeating thereinto during washing.

FIG. 2 through FIG. 10 show photographs of some areas of a digital garment according to the present invention;

As illustrated in FIG. 2 through FIG. 10, the digital garment may have various stitch types.

Figure 10:
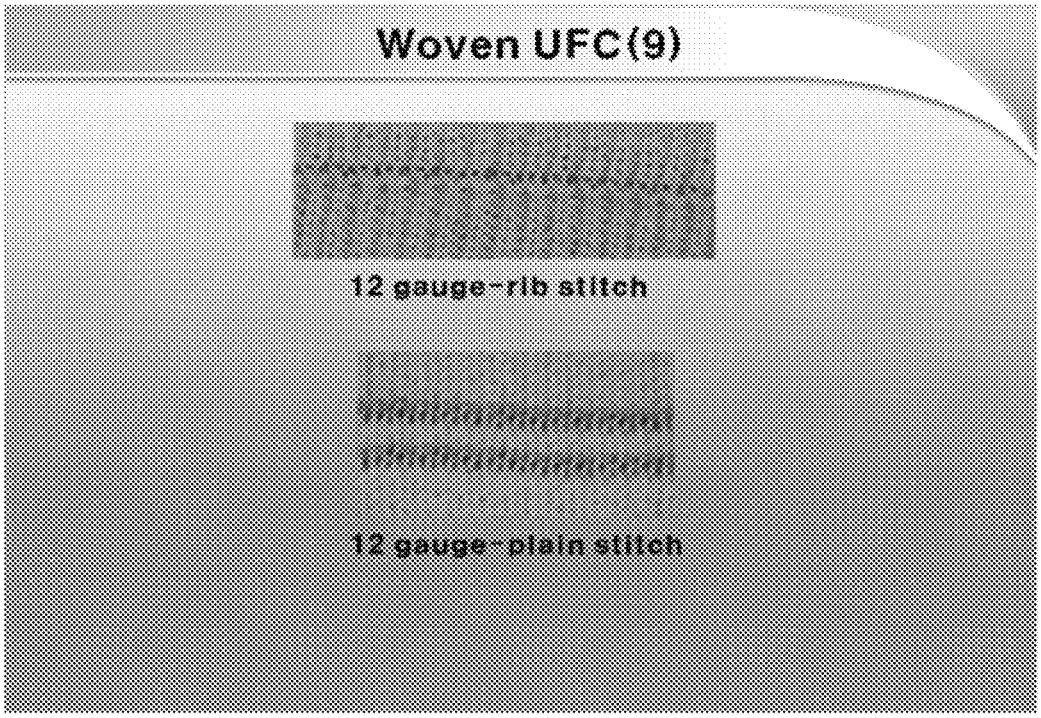

For example, the digital garment has a 7-gauge knit (FIG. 2), a 7-gauge mesh or cable stitch (FIG. 3), a 7-gauge rib or plain stitch (FIG. 4), a 10-gauge knit (FIG. 5), a 10-gauge mesh or cable stitch (FIG. 6), a 10-gauge rib or plain stitch (FIG. 7), a 12-gauge knit (FIG. 8), a 12-gauge mesh or cable stitch (FIG. 9), or a 13-gauge rib or plain stitch (FIG. 10). No limitation is imposed on the stitch type of the digital garment.

Figure 11:
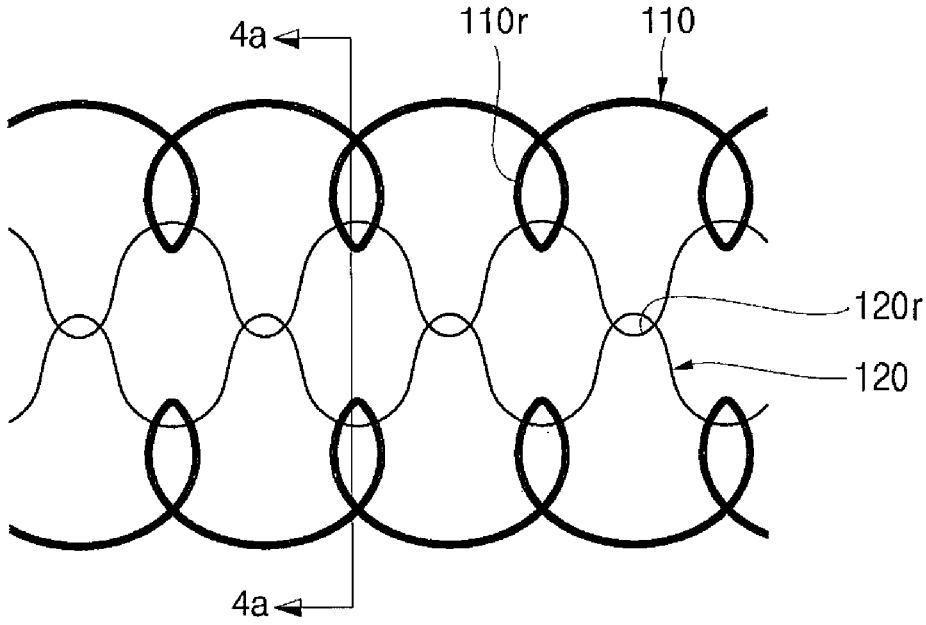
FIG. 11 is a partially enlarged view illustrating loops of a digital garment according to the present invention.
Figure 12:
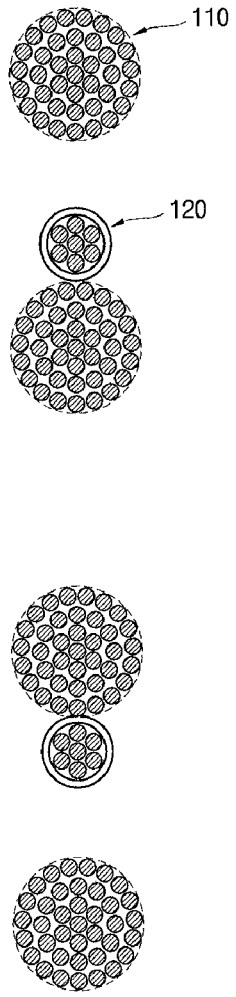
FIG. 12 and FIG. 13 illustrate a cross-sectional view taken along line 4*a*-4*a* of FIG. 11 and a partial perspective view of digital yarns only, respectively.
Figure 13:
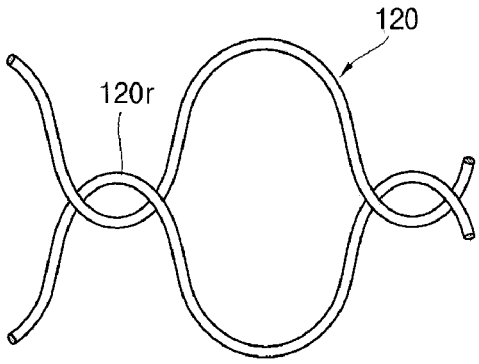

FIG. 11 is a partially enlarged view illustrating loops of a digital garment 100 according to the present invention; and FIG. 12 and FIG. 13 illustrate a cross-sectional view taken along line 4*a*-4*a* of FIG. 11 and a partial perspective view of digital yarns only, respectively.

As illustrated in FIGS. 11 and 12, the digital garment 100 comprises a plurality of knitting yarns 110 forming loops 110*r* at regular intervals and interwoven through the loops 110*r*, and one or more digital yarns 120 woven with the knitting yarns 110 and through which a current flows.

Herein, the plurality of loops 110*r* of the knitting yarns 110 can be arranged at regular intervals. The shapes of the knitting yarns 110 and the loops 110*r* illustrated in FIG. 11 are provided for illustrative purposes only, and there is no restriction on the knitted form of the knitting yarns 110. The knitting yarns 110 may be selected from, but not limited to, single-ply yarns, multiple-ply yarns and equivalents thereof.

There is no restriction on the weaving and knitting direction of the digital yarns 120. For example, the digital yarns 120 may be woven and knitted in the horizontal or vertical direction with respect to the loops 110*r* of the knitting yarns 110. Alternatively, the digital yarns may be woven and knitted in an inclined direction with respect to the loops 110*r* of the knitting yarns 110.

The digital yarns 120 form loops 120*r* at regular intervals and the loops 120*r* can be tied to loops 120*r* of other digital yarns 120. Further, the digital yarns 120 form loops 120*r* at regular intervals and the loops 120*r* can be tied to the loops 110*r* of the knitting yarns 110. That is, the digital yarns 120 can be knitted with other digital yarns 120 or between the knitting yarns 110. In this way, about 1 to about 300 circuits or lines for high-speed information communication can be formed using the digital yarns 120. The shapes of the digital yarns 120 and the loops 120 illustrated in FIG. 11 are provided for illustrative purposes only, and there is no restriction on the knitted form of the digital yarns 120.

The digital yarns 120 can be knitted in a wave-like pattern or its equivalent pattern with the knitting yarns 110 or another digital yarn 120, but the knitting pattern of the digital yarns 120 is not limited.

The knitting yarns 110 are relatively thick, compared to the digital yarns 120. In other words, the digital yarns 120 have a relatively small the thickness as compared to the knitting yarns 110. As a result, regions where communication circuits or lines are formed using the digital yarns 120 are relatively thin enough to be visually discernible.

Figure 14:
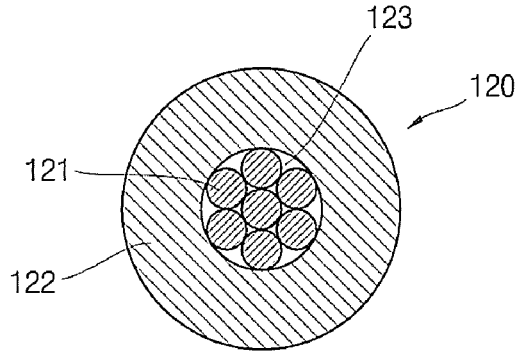
FIG. 14 and FIG. 15 illustrate enlarged cross-sectional views of digital yarns used in a digital garment according to an embodiment of the present invention.
Figure 15:
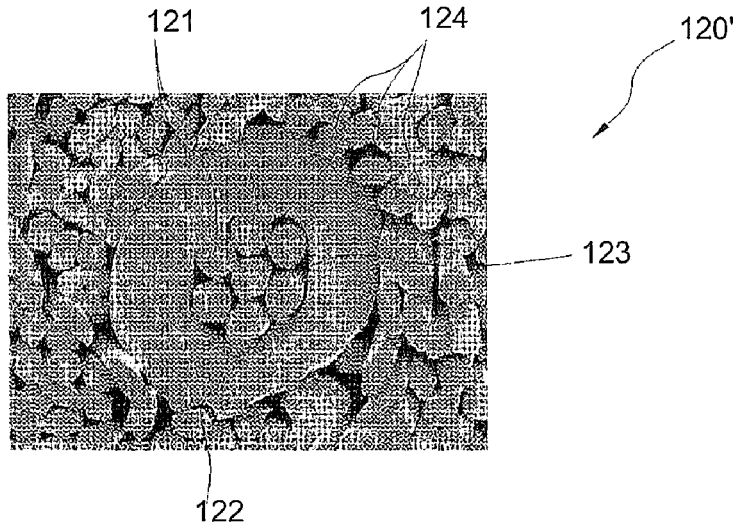

FIG. 14 and FIG. 15 illustrate enlarged cross-sectional views of digital yarns 120 and 120' used in a digital garment according to an embodiment of the present invention.

The digital yarn 120 includes one or more metal lines 121 and a coating layer 122 covering the metal lines 121. The metal lines 121 are made by casting and the coating layer 122 is formed of a resin. The metal lines 121 and the coating layer 122 are substantially circular in cross section. Voids may be formed in spaces between the metal lines 121 and the coating layer 122 where the coating layer 122 is not introduced between the metal lines 121.

The metal lines 121 are made of a metal having a low electrical resistance and a high elastic recovery under repeated bending. The metal lines 121 can be made of a material selected from copper, copper alloys, silver, silver alloys, gold, gold alloys, brass and combinations thereof. Seven metal lines 121 are illustrated in FIG. 14, but there is no limitation on the number of the metal lines 121.

The coating layer 122 is preferably formed of a waterproof material having the ability to shield electromagnetic waves. In other words, the coating layer 122 must block electromagnetic waves harmful to humans and protect the information communication performance of the metal lines 121 through electron migration from damage during washing of the garment. Particularly, for use in high-speed information communication, it is very important for the coating layer 122 to prevent data moving along the surfaces of the conductors from escaping to the outside or external noise from entering the metal lines 121 to cause a disturbance. Examples of suitable insulating materials for the coating layer 122 include, but are not limited to, ethylene tetrafluoroethylene (ETFE), fluorinated ethylene propylene (FEP), polytetrafluoroethylene (PTFE), polyvinylidene fluoride (PVDF), perfluoroalkoxy (PFA) and equivalents thereof.

In another embodiment, the digital yarn 120' further includes a plurality of cover yarns 124 surrounding the surface of the coating layer 122. The thickness of the cover yarns 124 is almost equal to the diameter of the metal lines 121. The cover yarns 124 are substantially parallel to the length direction of the coating layer 122. There is no limitation on the material for the cover yarns 124. For example, the cover yarns 124 may be substantially made of the same material as the knitting yarns 110.

The covering of the surfaces of the coating layer 122 with the cover yarns 124 further improves the strength of the digital yarn 120' to prevent the digital yarns from being snapped due to friction during knitting or washing. That is, since the digital yarn 120 is smaller in diameter than the knitting yarns 110, there exists the danger that the digital yarn 120 may be snapped due to friction during knitting or washing. In contrast, since the diameter of the digital yarn 120' including the cover yarns 124 is similar to that of the knitting yarns 110, there is no danger that the digital yarn 120' may be snapped due to friction during knitting or washing, and therefore, the performance of the digital yarn 120' as communication lines can be maintained for a long period of time.

Figure 16:
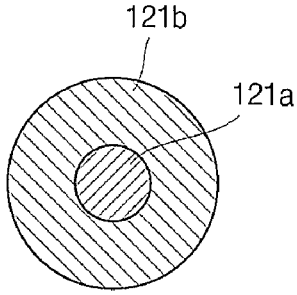
FIG. 16 and FIG. 17 illustrate enlarged cross-sectional views of metal lines used in a digital garment according to an embodiment of the present invention.
Figure 17:
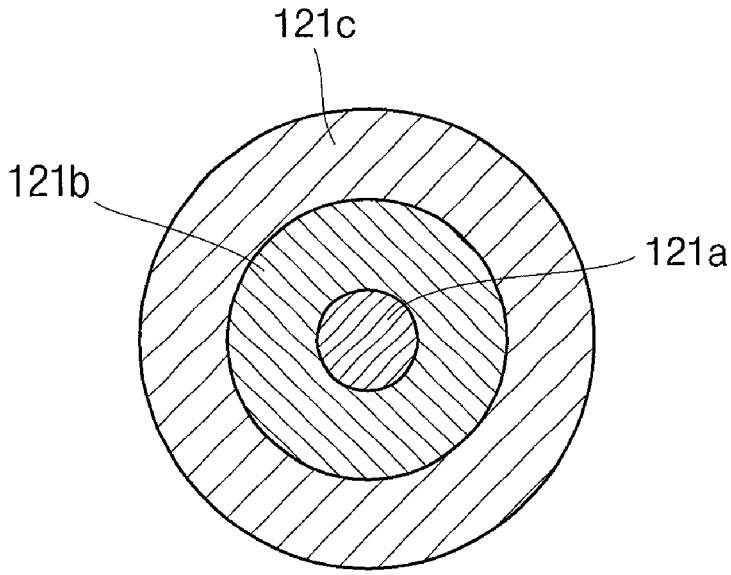

FIG. 16 and FIG. 17 illustrate enlarged cross-sectional views of metal lines 121 used in a digital garment according to an embodiment of the present invention.

Referring to FIG. 16, the metal line 121 may include a first metal line 121*a* and a second metal line 121*b* surrounding the first metal line 121*a*. The first metal line 121*a* is made of a material different from that of the second metal line 121*b*. The first metal line 121*a* and the second metal line 121*b* are substantially circular in cross section. The first metal line 121*a* is made of a material having a low electrical resistance and a high elastic recovery under repeated bending. Specifically, the material for the first metal line 121*a* is selected from copper, copper alloys, brass and equivalents thereof. The second metal line 121*b* can be made of a relatively highly conductive material for use in high-speed communication. The material for the second metal line 121*b* is determined taking into consideration the skin effect of the second metal line 121*b*. Specifically, the material for the second metal line 121*b* is selected from silver, silver alloys and equivalents thereof.

Referring to FIG. 17, the metal line 121 may further include a third metal line 121*c* surrounding the outer circumference of the second metal line 121*b*. The third metal line 121*c* is substantially circular in cross section and is made of a material different from the materials for the first metal line 121*a* and the second metal line 121*b*. The third metal line 121*c* can be made of a relatively highly conductive material for use in high-speed communication. Specifically, the material for the third metal line 121*c* is selected from gold, gold alloys and equivalents thereof.

Figure 18:
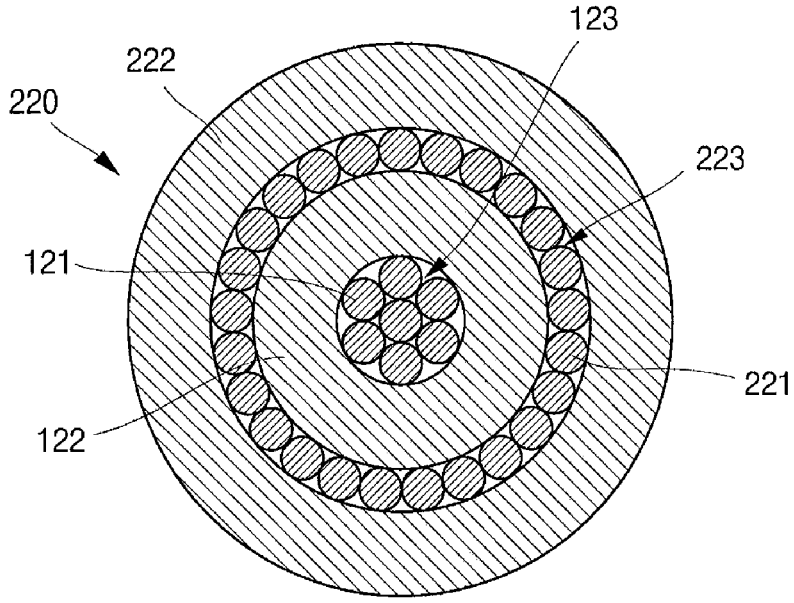
FIG. 18 is an enlarged cross-sectional view of a digital yarn used in a digital garment according to another embodiment of the present invention.

FIG. 18 is an enlarged cross-sectional view of a digital yarn 220 used in a digital garment according to another embodiment of the present invention.

As illustrated in FIG. 18, the digital yarn 220 further includes metal lines 121, a coating layer 122, a plurality of outer metal lines 221 formed along the outer circumference of the coating layer 122 and an outer coating layer 222 surrounding the outer circumferences of the outer metal lines 221.

Voids 123 may be formed in spaces between the metal lines 121 and the coating layer 122 during formation of the digital yarn 220. Also, voids 223 may be formed in spaces defined by the coating layer 122, the outer metal lines 221 and the outer coating layer 222.

The outer metal lines 221 are arranged at regular intervals along the outer circumference of the coating layer 122. Further, the outer metal lines 221 can be arranged densely so as to surround the circumference of the coating layer 122.

The outer metal lines 221 serve to block electromagnetic waves of the metal lines 121 from reaching the wearer and external electromagnetic noise from entering the metal lines 121. The outer metal lines 221 are made of the same material as the metal lines 121. The outer metal lines 221 formed outside the metal lines 121 have a sectional area larger than that of the metal lines 121. Due to this construction, the outer metal lines 221 can easily absorb electromagnetic noise. As a result, the outer metal lines 221 can serve to further improve the ability of the coating layer 122 to block noise.

The outer coating layer 222 is formed so as to surround the outer circumferences of the outer metal lines 221. The outer coating layer 222 is formed of the same material as the coating layer 221 to block external noise from entering therein.

In conclusion, the outer metal lines 221 and the outer coating layer 222 formed outside the metal lines 121 and the coating layer 122 can efficiently block electromagnetic waves of the metal lines 121 from reaching the wearer and external electromagnetic noise from entering the metal lines 121.

Although not shown, the digital yarn 220 may further include a plurality of cover yarns on the surface of the outer coating layer 222 to achieve improved strength. Due this improved strength, the digital yarn 220 can be prevented from being snapped due to friction during knitting or washing, and the performance of the digital yarn 120 as a communication line can be maintained for a long period of time.

Figure 19:
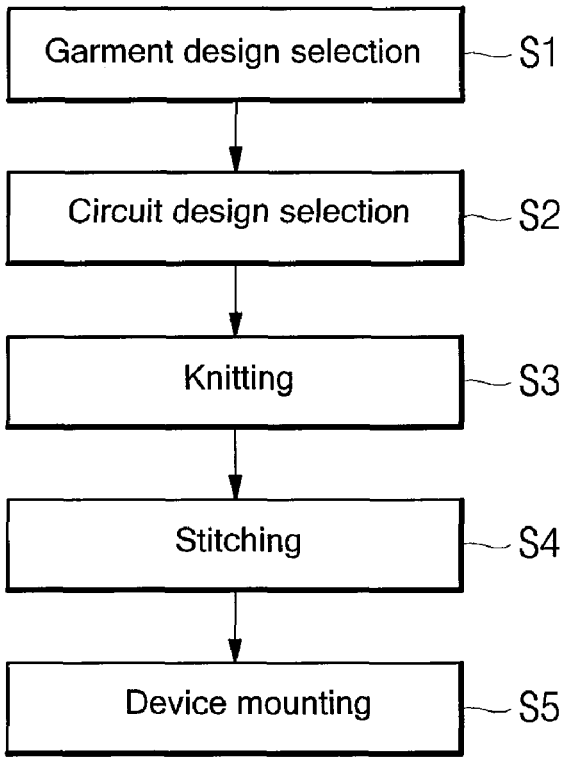
FIG. 19 is a flow chart for explaining a method for fabricating a digital garment using a knitting technique according to an embodiment of the present invention.

FIG. 19 is a flow chart for explaining a method for fabricating a digital garment using a knitting technique according to an embodiment of the present invention.

As illustrated in FIG. 19, the method comprises the following steps: garment design selection S1, circuit design selection S2, knitting S3, stitching S4 and device mounting S5.

In step S1, a worker selects a desired particular garment design from a plurality of predetermined garment designs.

In step S2, the worker selects a desired particular circuit design from a plurality of predetermined circuit designs. Steps S1 and S2 may be carried out in a reverse order. It is to be appreciated that the worker can design new ones in the user-defined mode.

In step S3, a plurality of knitting yarns are knitted so as to conform to the selected garment design and one or more digital yarns are knitted to form circuits corresponding to the selected circuit design between the knitting yarns.

In step S4, the knitted fabric is stitched or sewn to fabricate a garment.

In step S5, a variety of devices are electrically connected to the circuits of the digital yarns in the garment. Steps S4 and S5 may be carried out in a reverse order. That is, after the devices are electrically connected to the circuits, the garment is stitched.

In step S1, a coat garment design can be selected in which a body portion and arm portions are disposed opposite to each other at both sides of the body portion; and in step S3, the knitting yarns and the digital yarns can be knitted without any seams between the body portion and the arm portions, and the digital yarns can be integrally knitted from one of the arm portions to the other arm.

Figure 20:
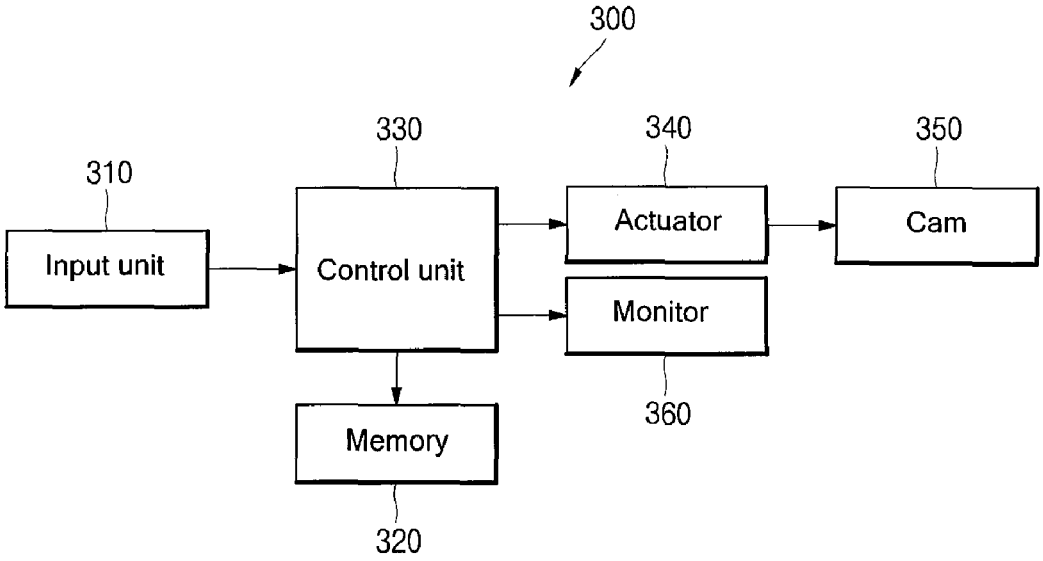
FIG. 20 is a block diagram illustrating the constitution of a knitting machine for fabricating a digital garment according to an embodiment of the present invention.

FIG. 20 is a block diagram illustrating the constitution of a knitting machine 300 for fabricating a digital garment according to an embodiment of the present invention.

As illustrated in FIG. 20, the knitting machine 300 comprises an input unit 310, a control unit 330 having a memory 320, an actuator 340 and a cam 350.

The input unit 310 may be selected from keypads, keyboards and equivalents thereof. By the use of the input unit 310, a worker selects a garment design, a circuit design and a knitting program. It should be understood that the worker can directly plan a garment design, a circuit design and a knitting program, and can amend and correct the selected ones.

The control unit 330 loads the garment design, the circuit design and the knitting program from the memory 320 in response to input signals of the input unit 310 to process the loaded data in a predetermined order. A plurality of garment designs, a plurality of circuit designs and a particular knitting program are previously stored in the memory 320. The control unit 330 may be composed of a central processing unit, buffers and input/output interfaces, but is not limited thereto.

The actuator 340 acts to convert electrical signals of the control unit 330 to mechanical signals and output the mechanical signals. For example, the actuator 340 may be selected from, but not limited to, air solenoids, hydraulic solenoids, electronic solenoids, and equivalents thereof.

The number of rotations of the cam 350 is dependent on the operation of the actuator 340. The cam 350 is operated in such a manner that knitting yarns and digital yarns are knitted so as to conform to the selected garment and circuit designs. Since the actuator 340 and the cam 350 are those used in a general knitting machine, they can be operated without difficulty by one skilled in the art and detailed explanation thereof is omitted.

The control unit 330 may further include a monitor for displaying knitting-related input command and control processing procedures, etc.

Steps S1, S2 and S3 are carried out using the knitting machine 300.

Figure 21:
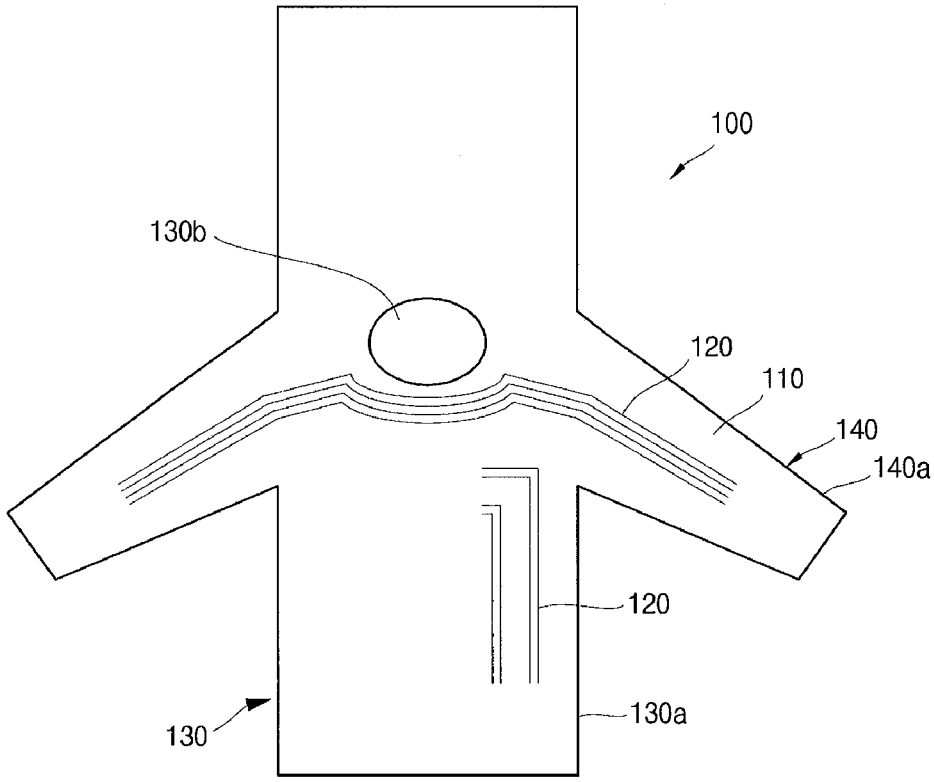
FIG. 21 is a plan view illustrating a fabric after knitting in a method for fabricating a digital garment according to an embodiment of the present invention.

FIG. 21 is a plan view illustrating a fabric after knitting in the method according to the embodiment of the present invention.

As illustrated in FIG. 21, in step S3, the knitting yarns 110 are mainly knitted so as to conform to the selected garment design to fabricate a fabric 100 and the digital yarns 120 are knitted in the horizontal or vertical direction with respect to the fabric 100 to form circuits. In FIG. 21, the digital yarns 120 are knitted so as to conform to the selected circuit design to form circuits from one of the arm portions 140 to the other arm portion 140 via the body portion 130. Circuits of the digital yarns 120 are also formed in the body portion 130 in the horizontal or vertical direction.

As illustrated, no stitched portions (i.e. seams) are formed between the arm portions 140 and the body portion 130 of the fabric 100. The circuits of the digital yarns 120 without being cut enable rapid fabrication of the digital garment 100 at reduced cost.

Reference numeral 130*b* indicates a hole through which the wearer's head passes.

Figure 22:
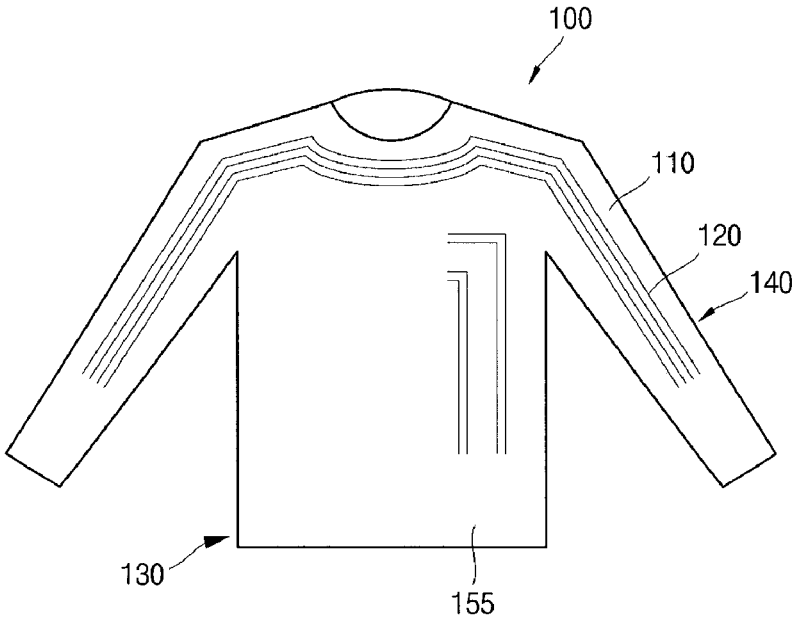
FIG. 22 is a plan view illustrating a garment after sewing in a method for fabricating a digital garment according to an embodiment of the present invention.

FIG. 22 is a plan view illustrating a garment after sewing in the method according to the embodiment of the present invention.

As illustrated in FIG. 22, after knitting, both lateral edges 130*a* of the body portion 130 are stitched or sewn, and the upper and lower edges 140*a* of the arm portions 140 are stitched or sewn to complete the fabrication of a wearable garment 100. No circuits of the digital yarns 120 pass through the lateral lines 130*a* of the body portion 130 and the upper and lower lines 140*a* of the arm portions 140. That is, there is no cutting of the circuits.

Figure 23:
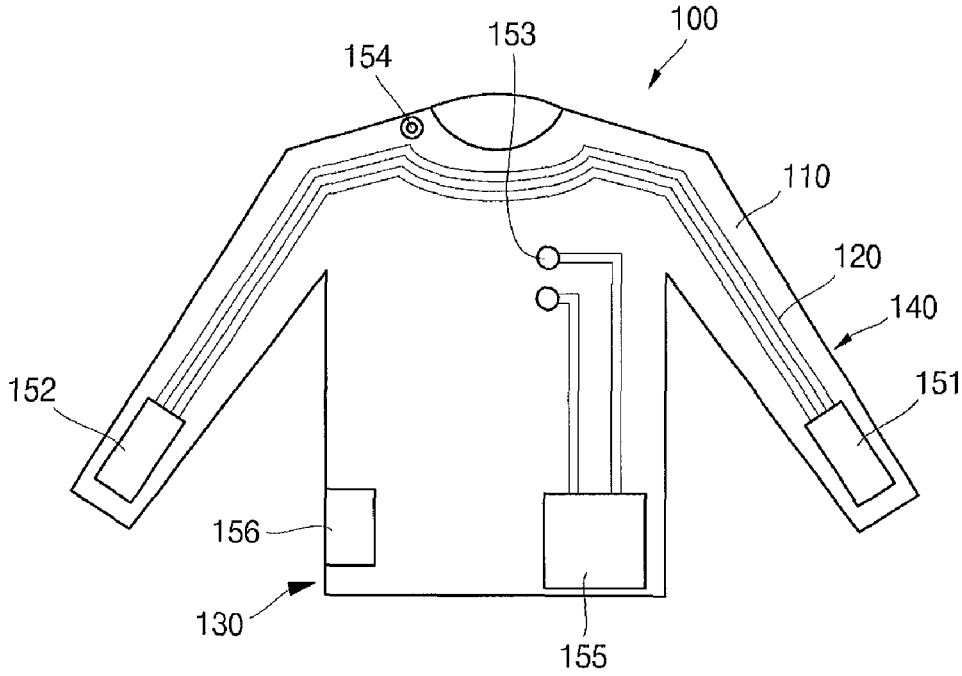
FIG. 23 is a plan view illustrating a garment to which digital devices are attached in a method for fabricating a digital garment according to an embodiment of the present invention.

FIG. 23 is a plan view illustrating a garment to which digital devices are attached in the method according to the embodiment of the present invention.

As illustrated in FIG. 23, in step S5, a device selected from a soft touch pad 151, an electric screen 152, a sensor 153, a wireless communication module 154, a computing device 155, an electric module 156 and equivalents thereof is electrically connected to each end of the circuits of the digital yarns 120 to complete the fabrication of the digital garment 100. The electrical connection of the devices 151 through 156 to the respective circuits of the digital yarns 120 can be accomplished using suitable connectors or by soldering. The connected portions between the digital yarns 120 and the devices 151 through 156 are waterproofed to prevent water from permeating thereinto during washing.

Although the forgoing embodiments have been described to practice the digital garment and the fabrication method of the present invention, these embodiments are merely illustrative and are not to be construed as limiting the invention. Those skilled in the art will readily appreciate that many modifications and variations can be made, without departing from the spirit and scope of the invention as defined in the appended claims, and such modifications and variations are encompassed within the scope and spirit of the present invention.

This work was supported by the IT R&D program of MIC/IITA [2006-S-029-02, Design and Development of Woven UFC (Ubiquitous Fashionable Computer) Technology].

The invention claimed is:

1. A digital garment comprising a plurality of knitting yarns forming loops at regular intervals and interwoven through the loops, and one or more digital yarns woven with the knitting yarns and through which a current flows, wherein the knitting yarns and the digital yarns are knitted together into a garment, wherein each of the digital yarns comprises at least one metal line positioned at the center of the cross section thereof to provide a communication path, and a coating layer being formed of a waterproof material and surrounding the metal line to shield electromagnetic waves, wherein the coating layer comprises a material selected from the group consisting of ethylene tetrafluoroethylene (ETFE), fluorinated ethylene propylene (FEP), polytetrafluoroethylene (PTFE), polyvinylidene fluoride (PVDF) and perfluroalkoxy (PFA), and wherein the coating layer is surrounded by a plurality of cover yarns that are made of the same material as the knitting yarns, and the plurality of cover yarns are parallel to the length direction of the coating layer.

2. The digital garment of claim 1, wherein the digital yarns are woven in the horizontal or vertical direction with respect to the loops of the knitting yarns.

3. The digital garment of claim 1, wherein the digital yarns form loops at regular intervals and the loops of the digital yarns are tied to the loops of the knitting yarns.

4. The digital garment of claim 1, wherein the digital yarns form loops at regular intervals and the loops of the digital yarns are tied to loops of other digital yarns.

5. The digital garment of claim 1, wherein the digital yarns are knitted in a wave-like pattern with the knitting yarns or another digital yarn.

6. The digital garment of claim 1, wherein the knitting yarns and the digital yarns are knitted into a mesh stitch, a cable stitch, a rib stitch, a plain stitch or a combination thereof.

7. The digital garment of claim 1, wherein the digital garment comprises a body portion and arm portions disposed opposite to each other at both sides of the body portion, the body portion and the arm portions being integrally knitted without any seams, and the digital yarns being woven with the knitting yarns from one of the arm portions to the other arm portion via the body portion.

8. The digital garment of claim 7, wherein the digital yarns are knitted with the knitting yarns in the horizontal or vertical direction with respect to the body portion.

9. The digital garment of claim 1, wherein a device selected from soft touch pads, electric screens, sensors, wireless communication modules, computing devices and electric modules is electrically connected to each end of the digital yarns.

10. The digital garment of claim 1, wherein the knitting yarns are single-ply yarns or multiple-ply yarns.

11. The digital garment of claim 1, wherein voids are formed in spaces between the at least on metal line and the coating layer wherein the coating layer is a hollow tube-shaped structure.

12. A method for fabricating a digital garment, the method comprising:

selecting a particular garment design from a plurality of predetermined garment designs;

selecting a particular circuit design from a plurality of predetermined circuit designs;

knitting a plurality of knitting yarns so as to conform to the selected garment design and knitting one or more digital yarns to form circuits corresponding to the selected circuit design between the knitting yarns;

stitching the knitted fabric to fabricate a garment; and electrically connecting electronic devices to the circuits of the digital yarns in the garment, wherein each of the digital yarns comprises at least one metal line positioned at the center of the cross section thereof to provide a communication path, and a coating layer being formed of a waterproof material and surrounding the metal line to shield electromagnetic waves, wherein the coating layer comprises a material selected from the group consisting of ethylene tetrafluoroethylene (ETFE), fluorinated ethylene propylene (FEP), polytetrafluoroethylene (PTFE), polyvinylidene fluoride (PVDF) and perfluroalkoxy (PFA), and wherein the coating layer is surrounded by a plurality of cover yarns that are made of the same material as the knitting yarns, and the plurality of cover yarns are parallel to the length direction of the coating layer.

13. The method of claim 12, wherein in the garment design selection step, a coat garment design is selected in which a body portion and arm portions are disposed opposite to each other at both sides of the body portion; and in the knitting step, the knitting yarns and the digital yarns are knitted without any seams between the body portion and the arm portions, and the digital yarns are integrally knitted from one of the arm portions to the other arm.

14. The method of claim 12, wherein the garment design selection step, the circuit design selection step and the knitting step are carried out using a knitting machine, the knitting machine comprising an input unit for selecting a garment design, a circuit design and a knitting program, a control unit for loading the garment design, the circuit design and the knitting program from a memory in response to input signals of the input unit to process the loaded data, an actuator mechanically operating in response to control signals of the control unit, and a cam operated by the actuator.

15. The method of claim 12, wherein in the knitting step, the circuits are formed by knitting the digital yarns in the horizontal or vertical direction with respect to the garment.

* * * * *